US005242041A

United States Patent [19]

Isobe

[11] Patent Number: 5,242,041

[45] Date of Patent: Sep. 7, 1993

[54] APPARATUS FOR CURRENCY VALIDATION

[75] Inventor: Atsushi Isobe, Kawasaki, Japan

[73] Assignee: Japan Cash Machine Co., Ltd., Osaka, Japan

[21] Appl. No.: 730,642

[22] Filed: Jul. 16, 1991

[30] Foreign Application Priority Data

Jul. 19, 1990 [JP] Japan ..... 2-76119[U]

[51] Int. Cl.[5] ..... G07F 7/04

[52] U.S. Cl. ..... 194/207; 194/349; 194/351

[58] Field of Search ..... 194/203, 206, 207, 349, 194/351; 271/245; 209/534

[56] References Cited

U.S. PATENT DOCUMENTS 3,190,426 6/1965 Cahill et al. ..... 194/203 X
3,924,847 12/1975 Pescetto ..... 209/534 X
4,050,562 9/1977 Schwippert et al. ..... 194/261
4,628,194 12/1986 Dobbins et al. ..... 209/534 X
4,722,519 2/1988 Zouzoulas ..... 271/181

FOREIGN PATENT DOCUMENTS 54-130096 10/1979 Japan ..... 194/206

*Primary Examiner*—F. J. Bartuska
*Attorney, Agent, or Firm*—Bachman & LaPointe

[57] ABSTRACT

An apparatus for currency validation is disclosed in which a belt-pulley arrangement is provided in a housing to transport a bill along a passageway for identification of the bill by sensing the optical or magnetic characteristics of the bill. A lever with notches is mounted for rotation between a protective position protruded within the passageway and a release position retracted from the passageway. When a thin tool is inserted into the passageway, it is engaged with the notches of the lever to prevent movement of the lever from the protective to the release position.

5 Claims, 5 Drawing Sheets

APPARATUS FOR CURRENCY VALIDATION

BACKGROUND OF THE INVENTION (a) Field of the Invention

The present invention relates to an apparatus for currency validation, in particular to improvement of a device for preventing unauthorized removal of a bill received in the apparatus.

(b) Description of the Prior Art

Current bill handling apparatuses include money exchanging or vending machines each provided with a bill validator for identifying the authenticity or denomination of a bill or paper currency inserted therein. When inserted into an inlet of the validator, the bill is conveyed by a belt-pulley arrangement to a sensor which detects optical or magnetic characteristics of the bill. When the bill validator identifies the insertion with a genuine bill from outputs of the sensor, it is then carried to a stacker wherein bills are accumulated for storage while exchanged bills or coins or goods are put out in a tray of the machine. Adversely, if the bill validator can not decide the insertion as a genuine bill, the belt-pulley arrangement is driven in the reverse direction to return same to the inlet. For instance, U.S. Pat. No. 4,628,194 indicates a prior art validator and U.S. Pat. No. 4,722,519 shows a stacker apparatus.

In some cases, a string-like material such as a thread or tape is intentionally attached to one end of a bill which is then inserted into the inlet of the validator. The bill is transported along a passageway in the bill validator by the belt-pulley arrangement through the sensor to the stacker or an escrow compartment as shown in U.S. Pat. No. 4,050,562, and an exchange is thrown out on the tray of the apparatus. After that, the bill is pulled back from the apparatus by pulling the string.

Many attempts have been made in the past for preventing unauthorized removal of a bill contained within the stacker. FIGS. 6 and 7 show a prior art apparatus for preventing improper removal of a bill. As illustrated, a passageway 1 is provided in a bill validator for transporting a bill 7 to a stacker or escrow compartment. Firstly, entry of the bill 7 into an inlet of the passageway 1 is detected by an optical sensor (not shown) which produces an electric signal to a control unit. Upon occurrence of the signal from the optical sensor, a feed motor is activated to carry the bill 7 toward the stacker by means of a belt-pulley arrangement. On the way of movement of the bill, a sensor detects optical or magnetic characteristics to convert same into electric signals to the control unit.

A lever 2 is mounted on a shaft 3 for rotation between a protective position protruded within the passageway 1 and a release position retracted from the passageway 1. A spring 4 is wound around the shaft 3 to resiliently urge the lever 2 toward the protective position.

When the bill 7 passes through the lever 2, a leading edge of the bill 7 comes into contact with and forcibly turns the lever 2 in clockwise direction against weak resilient force of the spring 4. Accordingly, the lever 2 is rotated by the bill 7 to the release position retracted from the passageway 1. After the bill 7 has passed over the lever 2, elastic force of the spring 4 returns the lever 2 to the protective position protruded within the passageway 1.

Once the bill 7 has passed beyond the lever 2, it prevents withdrawal of the bill 7 toward the inlet as the lever 2 protrudes within the passageway 1 under the resilient force of spring 4, and the lever 2 frustrates an attempt to pull back the bill 7.

However, it is possible to insert a thin tool 8 into the passageway 1 as illustrated in FIG. 7 and to push down the lever 2 to the release position by the tool 8 against the weak force of spring 4. In this case, by pulling the string material 6, the bill 7 may be pulled back beyond the lever 2 which is kept in the release position by the tool 8.

SUMMARY OF THE INVENTION

Accordingly, it is an object of the present invention to provide an apparatus for currency validation for effectively preventing unauthorized removal of a bill from the apparatus.

It is another object of the present invention to provide an apparatus for preventing improper removal of a bill therefrom with stopper means which is capable of being automatically actuated between the protective position protruded within a passageway for the bill and the release position retracted from the passageway.

According to the present invention, an apparatus for currency validation is provided which comprises a housing; a belt-pulley arrangement mounted in the housing for forming a passageway for a bill and for transporting the bill along the passageway; sensor means disposed adjacent to the passageway for detecting optical or magnetic characteristics of the bill: and stopper means mounted in the housing for movement by operation of an actuator between a protective position protruded within the passageway and a release position retracted from the passageway. The stopper means is provided with at least a notch in the front side thereof facing an inlet of the passage. The notch is engageable with a thin tool inserted from the inlet into the passageway to prevent movement of the stopper means from the protective to the release position. When transported to the stacker or escrow compartment, even though the bill is pulled back to the inlet, it comes into contact with a rear side of the stopper means, thereby preventing removal of the bill from the apparatus. The stopper means may naturally prevent further intrusion of the thin tool. In the preferred embodiment of the present invention, the stopper means is mounted in the housing for rotation around a pin between the protective and release positions.

The apparatus of the invention may further comprises a spring for resiliently urging the stopper means toward the protective position; a sensor for detecting the stopper means in the release position; a bill validator for identifying authenticity of the bill passing through the passageway; a control unit for producing a drive signal in accordance with an output from the bill validator; and an actuator for moving the stopper means from the protective to the release position when the bill passes through the passageway and for moving the stopper means from the release to protective position in response to the drive signal output from the control unit after the bill passes through the stopper means so that the notches are engageable with a thin tool inserted from the inlet into the passageway to prevent movement of the stopper means from the protective to the release position. The control unit outputs the drive signal to move the stopper means from the protective to the release position after the bill validator identifies an acceptable bill and before the bill passes through the stopper means. The stopper means is disposed between sensor means of the bill validator and an outlet of the passageway.

In operatin, the bill is inserted from an inlet and transported along the passageway by the belt-pulley arrangement. At the same time, the stopper means is moved from the protective to the release position by an actuator. When the validator detects predetermined optical or magnetic characteristics of the bill and decides the bill as genuine, the belt-pulley arrangement conveys the bill toward the stacker or escrow compartment, and after the bill has passed the stopper means which is in the release position, the actuator returns the stopper means to the protective position. When the validator can not decide the bill as genuine, the belt-pulley arrangement is driven in the reverse direction to return the bill to the inlet. Also, the actuator is activated to move the stopper means from the release to the protective position.

A string material is attached to an authentic bill which is then inserted into the inlet of the passageway. The belt-pulley arrangement conveys the bill to the stacker or escrow compartment. When the bill is drawn back from the stacker or escrow compartment by pulling the string material, the stopper means completely hinders withdrawal of the bill because the stopper means is in the protective position protruded within the passageway. In addition, when a thin tool is inserted from the inlet to move the stopper means to the release position, it comes into engagement with the notch formed in the stopper means, thereby preventing movement of the stopper means to the release position and also further intrusion of the tool into the apparatus.

BRIEF DESCRIPTION OF THE DRAWINGS

The features and advantages of the present invention will be clearly understood with reference to the accompanying drawings. FIGS. 1–5 illustrate a best embodiment of the apparatus for currency validation according to the present invention, wherein:

FIG. 1 is a cross section of the apparatus for currency validation according to the present invention;

FIG. 2 is a perspective view of stopper means utilized in the apparatus;

FIG. 3 illustrates a partial section of the stopper means in the protective position;

FIG. 4 is a block diagram of an electric circuit utilized to automatically operate the stopper means;

FIG. 5 shows a flow chart illustrating an operational sequence of the circuit shown in FIG. 4;

DETAILED DESCRIPTION OF THE INVENTION

Figure 1:
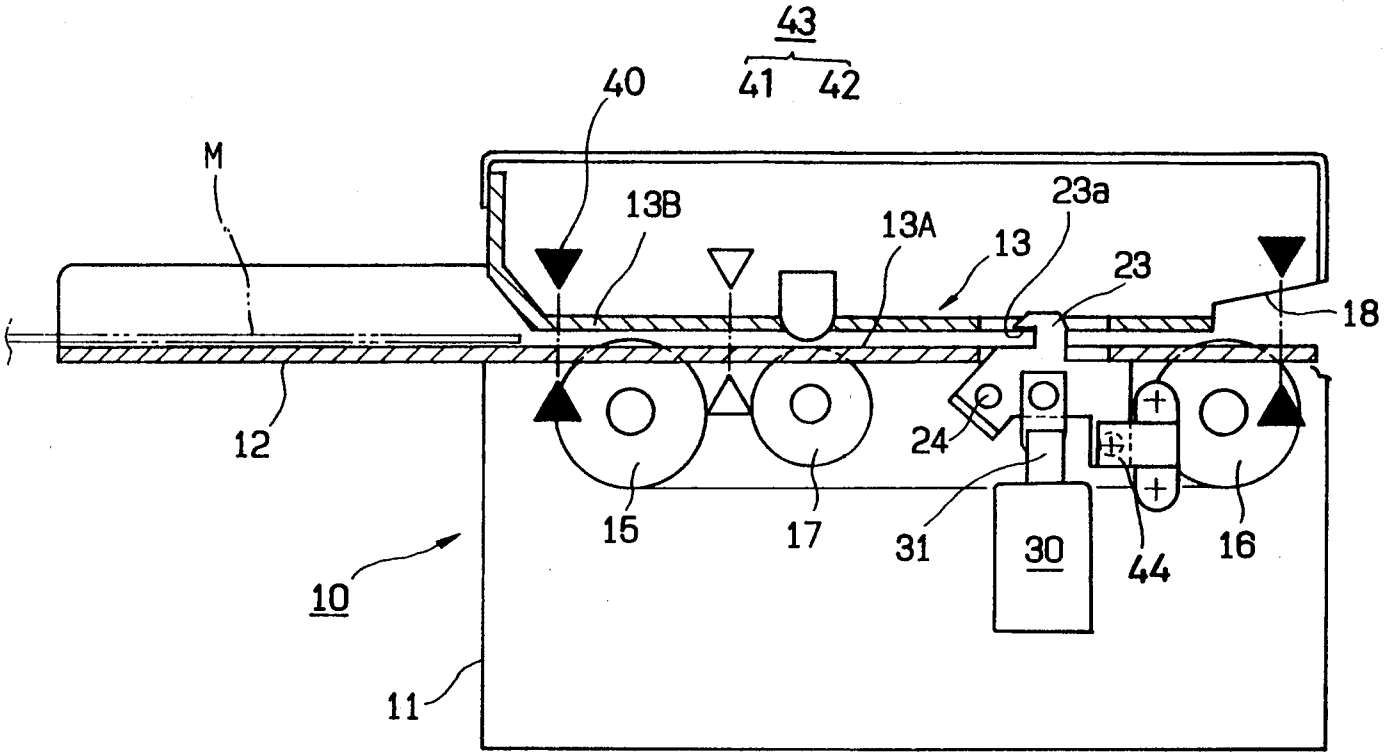
Figure 2:
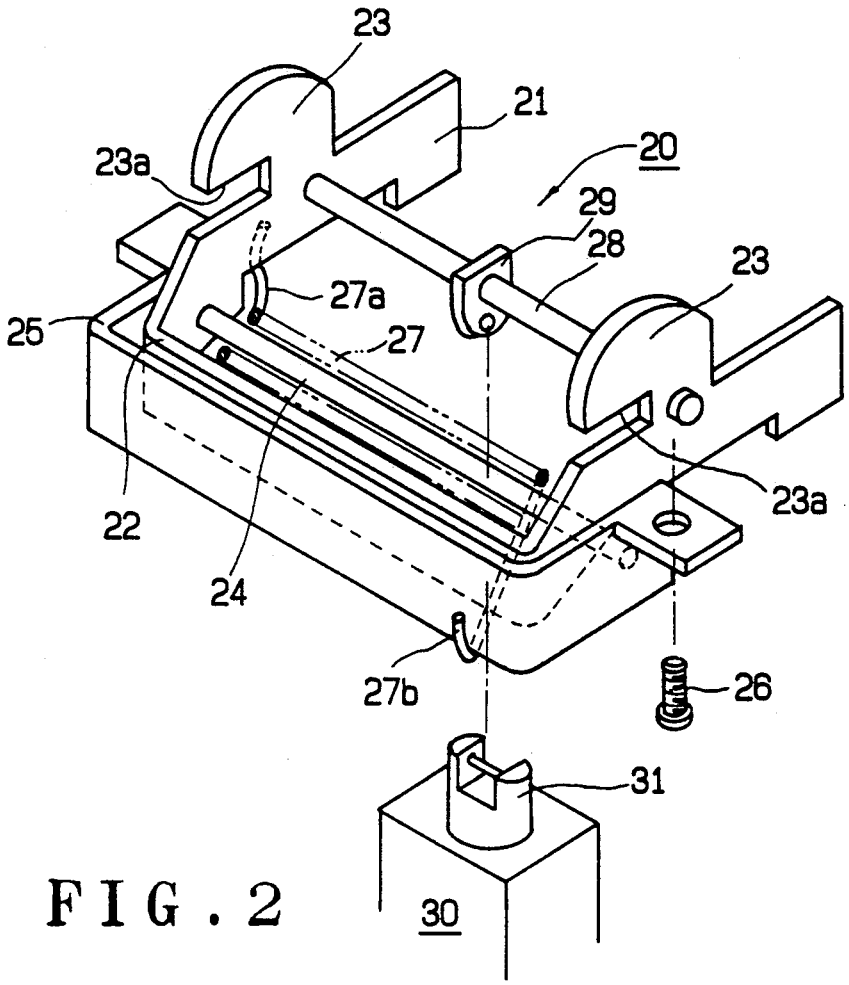

As obvious in FIG. 1, a validator 10 includes a housing 11, a table 12 provided at a front side of the housing for forming an inlet 14 for a bill M at the inner end of the table 12, a passageway 13 extending from the inlet 14 through the housing 11 and terminating at an outlet 18, photosensors 40 and 45 disposed in the vicinity of the inlet 14 and outlet 18 of the passageway for detecting existence of the bill M, sensor means 43 including optical sensors 41 for detecting white and infrared rays reflected on a surface of the bill M or passing through the bill M and a magnetic head 42 for detecting ferrous component which is contained in a genuine bill printed entirely with magnetic ink; and feed rollers 15 to 17 of a belt-roller arrangement provided along the passageway 13. A stacker not shown is provided adjacent to the outlet 18 to directly transport the bill M from the validator 10 to the stacker.

Provided halfway on the passageway 13 is stopper means 20 to prevent unauthorized withdrawal of the bill M. As clearly indicated in FIG. 3, the stopper means 20 comprises a lever 21 mounted on a shaft 24 for rotation between a protective position shown in FIG. 1 wherein the lever 21 is protruded within the passageway 13 and a release position wherein the lever 21 is rotated out of the passageway 13, a bracket 25 securely attached to the housing 11 by screws 26 for supporting the shaft 24 in order to rotate the lever 21, and a spring 27 wound around the shaft 24 for resiliently urging the lever 24 toward the protective position. The lever 21 is formed into substantially U-shape with hook portions 23 parallel to the passageway 13 and a transverse plate 22 for connecting these hook portions 23. A notch 23*a* is formed in each of the hook portions 23 in parallel relation to the passageway 13. The notch 23*a* is formed into a slit facing the inlet 14 of the passageway 13. The shaft 24 is provided in parallel relation to the transverse plate 22. One end 27*a* of the spring 27 is securely attached to a suitable portion of the lever 21 or hook portions 23, and the other end 27*b* of the spring 27 is fixed to the bracket 25.

Figure 3:
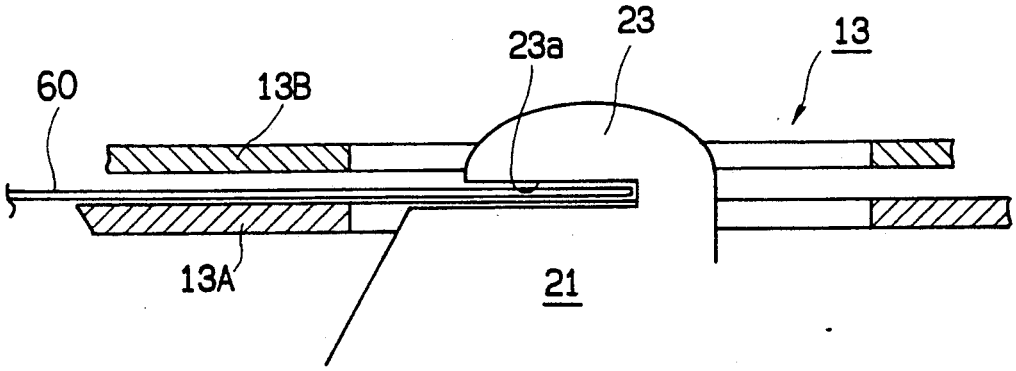

In FIG. 3, the hook portion 23 is in the protective position projecting through each hole formed in bottom and upper plates 13A and 13B which define the passageway 13. The notch 23*a* of the hook portion 23 is positioned in alignment with the passageway 13.

A retaining rod 28 extending between hook portions 23 is provided with a flange 29 which is connected with a plunger 31 of an actuator or solenoid 30. When the solenoid 30 is activated, it pulls the plunger 31, thereby causing the hook portions 23 to rotate clockwise from the protective to the release position away from the passageway 13 around the shaft 24 against elastic force of spring 27. When the solenoid 30 is deactivated, the hook portions 23 of the stopper means 20 is rotated from the release to the protective position by virtue of the spring 27. FIG. 1 exhibits a photosensor 44 positioned adjacent to the stopper means 20 for detecting movement of the hook portions 23 between the protective and release positions.

Figure 4:
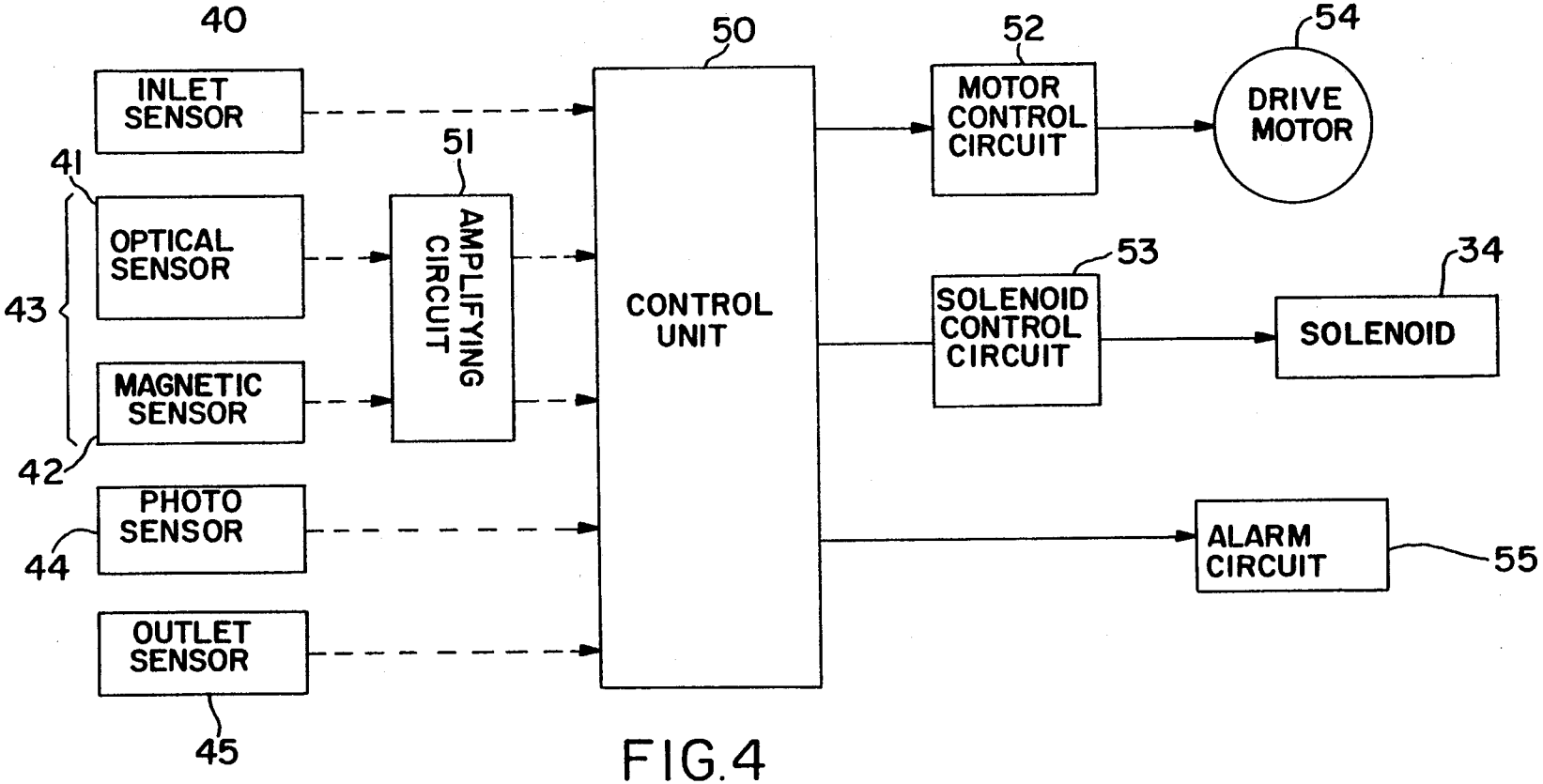

Illustrated in FIG. 4 is an electric circuit for controlling each electric component of the apparatus. The electric circuit comprises a control unit 50 of for example one chip microcomputer which has a plurality of input terminal connected with inlet and outlet sensors 40 and 54, photosensor 44 and sensor means 43 through an amplifying circuit 51. The control unit 50 is also provided with output terminals each connected with a motor control circuit 52, a solenoid control circuit 53 and an alarm circuit 55. The motor control circuit 52 produces output to drive a motor 54 and thereby to actuate feed rollers 15 to 17 of the belt-roller arrangement in a predetermined condition. The solenoid control circuit 53 gives rise to output to activate the solenoid 30 so that the stopper means 20 is moved to the release position. The alarm circuit 55 is activated when an unacceptable bill M is returned to the inlet 14 by the belt-roller arrangement or when the stopper means 20 is forcibly moved to the release position without identification of authenticity of the bill M based on outputs of the sensor means 43.

Figure 5:
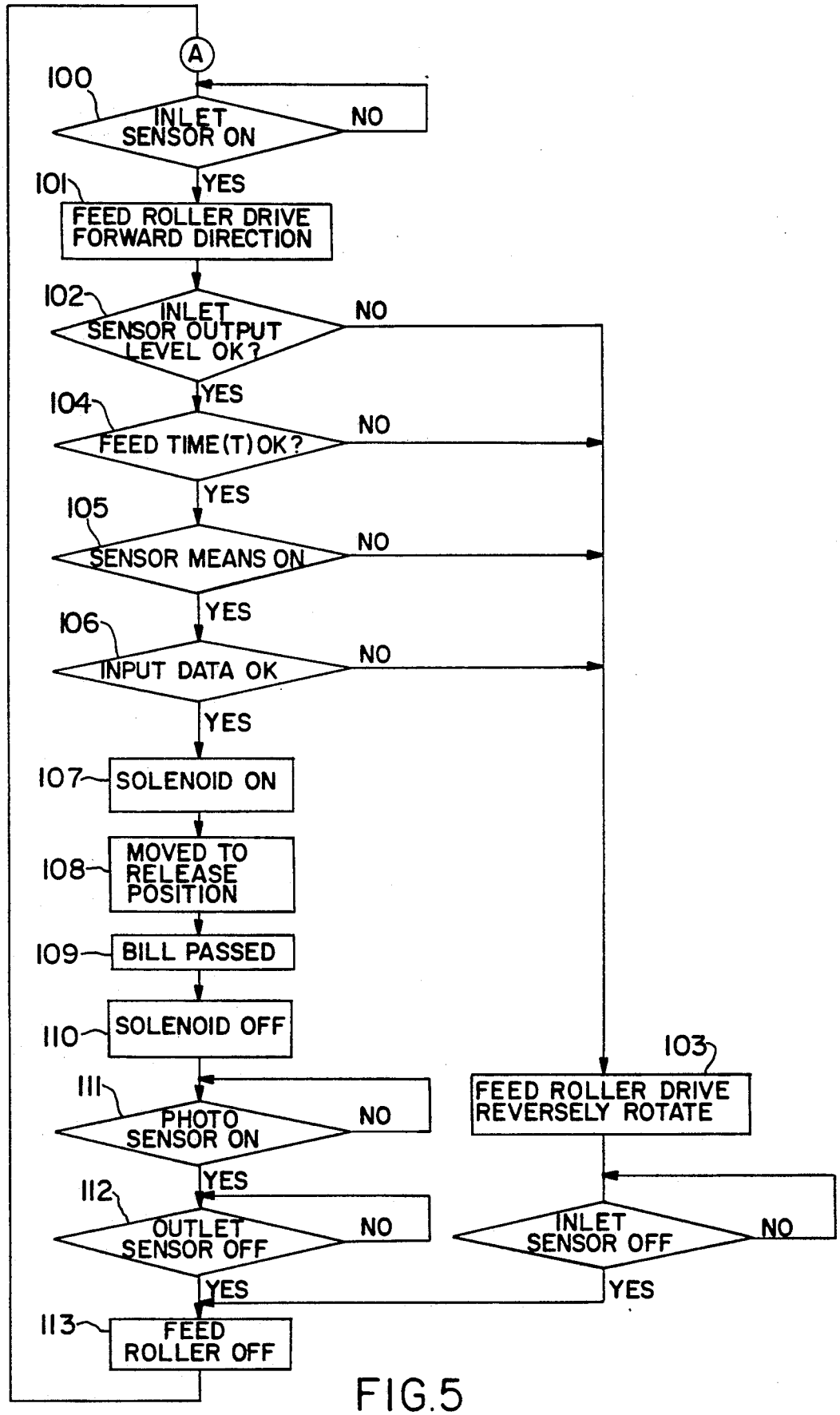
Figure 6:
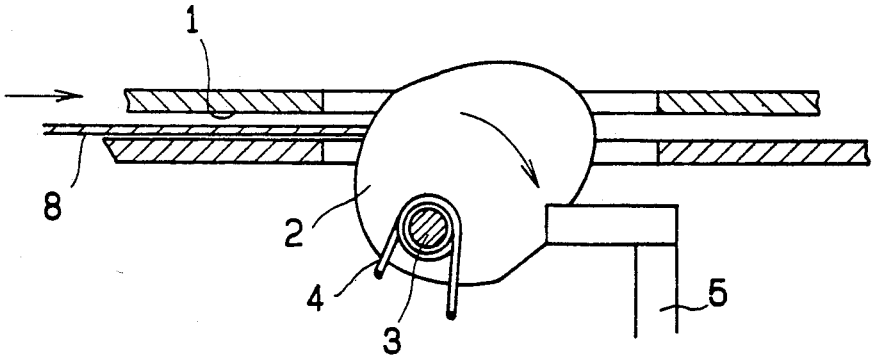
Prior Art FIG. 6
FIG. 6 is a section view of a prior art device when a bill passes through a lever.
Figure 7:
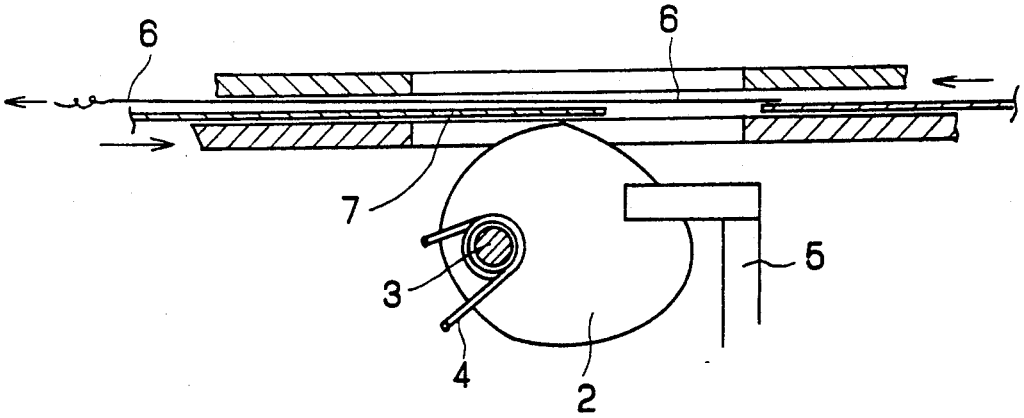
Prior Art FIG. 7
FIG. 7 is a section of the lever when the bill is pulled out the prior art device.

The operation of the circuit shown in FIG. 1 is described with reference to FIG. 5 indicating a flow chart of the operational sequence of the circuit.

The control unit 50 decides by an output of the inlet sensor 40 whether or not bill M is inserted into the inlet 14 (Step 100). When the bill M is inserted into the inlet 14, the inlet sensor 40 forwards an output to the control unit 50 which in turn produces a drive signal to the motor control circuit 52, and thereby the motor 54 is rotated in a forward direction (Step 101). Then, the bill is carried along the passageway 13 from the inlet 14 through sensor means 43 toward the outlet 18 by feed rollers 15 to 17 of the belt-roller arrangement.

In step 102, the control unit 50 determines based on the output of the inlet sensor 40 whether or not the amount of light which has passed through the bill M and been received by the inlet sensor 40 is in a predetermined range of light intensity. If the received amount of light is outside the predetermined range, the bill M is not regarded as authentic. As a result, the motor 54 is rotated in a reverse direction, thereby causing feed rollers 15–17 to reversely rotate, rejecting the unacceptable bill M toward the inlet 14 (Step 103).

If the received amount of light is within the predetermined range of level, the bill M is considered authentic, and in Step 104, feed time T is detected which is required for movement of the bill M from the inlet sensor 40 to the sensor means 43. If the bill M does not reach the sensor means 43 within a predetermined period of time, similarly to the foregoing, decision is made to go to Step 103 for rejection of the bill M and return the bill to the inlet 14. When the bill M is transported within the predetermined period of time, the optical sensor 41 and the magnetic head 42 detect optical and magnetic factors of the bill M for the determination of the authenticity (Step 105) so that data obtained from the sensor means 43 is checked by the control unit 50 (Step 106). In Steps 105 and 106, if the sensor means 43 does not detect the inherent signals from the bill M, if the detected data is not supplied to the control unit 50, or if incorrect data is forwarded to the control unit 50, the bill M is not considered authentic so that it is rejected to the inlet 14. In case a distance between the sensor means 43 and stopper means 20 is shorter than the full length of the bill M, the solenoid 34 may be activated to move the stopper means 20 to the release position by detecting a part of whole data from the bill M. Alternatively, in case enough distance between the sensor means 43 and stopper means 20 is longer than the full length of the bill M, the solenoid 34 can be activated after whole data is detected from the bill M.

When the sensor means 43 in Step 105 detects predetermined data from the bill M, it is subsequently forwarded to the control unit 50 in Step 106, and processing moves to Step 107 wherein the control unit 50 compares data detected by the sensor means 43 with reference data stored in the control unit 50. If the detected and stored data are considered equivalent to each other, the control unit 50 produces a drive signal to the solenoid control circuit 53 thereby causing the activation of the solenoid 34. Accordingly, the plunger 31 is pulled by the solenoid 34 and the lever 21 is moved from the protective to the release position (Step 108) against force of the spring 27. The sensor 44 detects the movement of the hook portions 23 to the release position.

In this time, the hook portions 23 are pulled down below and away from the passageway 13. Then, the bill M is carried by the belt-pulley arrangement over the stopper means 20 (Step 109) and the solenoid 34 is deactivated so that the lever 21 is returned to the protective position by resilient force of the spring 27 (Step 110). The sensor 44 detects the movement of the hook portions 23 to the protective position protruded within the passageway 13 (Step 111). In Step 112, the control unit 50 decides whether or not the outlet sensor 45 detects passage of the bill M therethrough. When the outlet sensor 45 detects passing of the bill M, the control unit 50 ceases to supply the drive signal to the motor control circuit 52 in order to stop operation of the belt-pulley arrangement (Step 113). In Step 103, the belt-pulley arrangement is driven in the reverse direction and the unacceptable bill M is returned to the inlet 14. In Step 114, when the inlet sensor 40 detects complete discharge of the bill M to the table 12, the control unit 50 ceases to supply the drive signal to the motor control circuit 52 and the motor is stopped.

Now, assume that a string material is attached to the bill M and is pulled back after the bill M has passed the outlet sensor 45. Because the hook portions 23 of the stopper means 20 protrude into the passageway 13 in the protective position, the bill M is brought into contact with the back side of the hook portions 23, and therefore the stopper means 20 prevents removal of the bill M even when the string material is pulled back. In addition, if a thin tool 60 is inserted into the passageway 13, it engages with notches 23*a* of the hook portions 23 so that it is prevented from further intrusion into the apparatus. In other words, the tool 60 can not forcibly move the hook portions 23 to the release position below the passageway 13. It should be now appreciated that the device according to the present invention is very effective to completely prevent unauthorized removal of the bill.

The present invention may be varied in various ways. For instance, the stopper means 20 may include only one hook portion with notch or more than three. In addition, the stopper means 20 may be mounted for reciprocal movement between the protective and release positions in lieu of rotational movement as abovementioned.

What is claimed is:

1. In an apparatus for currency validation which includes a housing having an inlet; a belt-pulley arrangement mounted in said housing for forming a passageway for a bill inserted from the inlet and for transporting said bill along said passageway; sensor means electrically connected to a control unit of the bill validator for identifying authenticity of the bill passing through the passageway; and stopper means mounted in the housing for movement by operation of an actuator between a protective position protruded within the passageway and a release position retracted from said passageway;

the improvement comprising at least one hook portion which provides a notch formed in the front side of said stopper means facing the inlet of the passageway, said stopper means being positioned between said sensor means and an outlet of the passageway; said stopper means being moved from the protective to release position by the actuator only when the bill validator identifies authenticity of the bill; and said notch being engageable with a thin tool inserted from the inlet into the passageway to prevent movement of the stopper means from the protective to the release position and operable to lock the stopper means in the protective position.

2. An apparatus for currency validation of claim 1 wherein said control unit supplies the actuator with a drive signal to move the stopper means from the protective to the release position after the bill validator identifies an acceptable bill before the bill passes through the stopper means.

3. An apparatus for currency validation of claim 1 further comprising a sensor for detecting movement of the stopper means to the release position.

4. An apparatus for currency validation of claim 1 further comprising an outlet sensor for detecting passing of the bill.

5. An apparatus for currency validation of claim 1 wherein said stopper means is returned from the release to protective position after the bill has passed through the stopper means.

* * * * *